United States Patent [19]

Simcock

[11] Patent Number: 5,059,762

[45] Date of Patent: Oct. 22, 1991

[54] MULTIPLE ZONE INDUCTION HEATING

[75] Inventor: John H. Simcock, Droitwich, United Kingdom

[73] Assignee: Inductotherm Europe Limited, Hereford, United Kingdom

[21] Appl. No.: 597,611

[22] Filed: Oct. 15, 1990

[30] Foreign Application Priority Data

Oct. 31, 1989 [GB] United Kingdom ..... 8924436
Jul. 2, 1990 [GB] United Kingdom ..... 9014659

[51] Int. Cl.[5] ..... H05B 6/08

[52] U.S. Cl. ..... 219/10.77; 219/10.71; 323/328; 323/338

[58] Field of Search ..... 219/10.77, 10.71, 10.75, 219/10.41, 10.43, 503, 497, 490; 323/339, 338, 329, 328

[56] References Cited

U.S. PATENT DOCUMENTS 3,612,805 10/1971 Kennedy ..... 219/10.75
3,665,149 5/1972 Sakabe et al. ..... 219/130.51
3,740,859 6/1973 Patton et al. ..... 219/10.77
4,359,620 11/1982 Keller ..... 219/10.75
4,506,131 3/1985 Boehm et al. ..... 219/10.77
4,737,704 4/1988 Kalinnikov et al. ..... 323/339
4,973,815 11/1990 Ito et al. ..... 219/110

FOREIGN PATENT DOCUMENTS 1167943 10/1969 United Kingdom .
1438792 6/1976 United Kingdom .
2203319 10/1988 United Kingdom .
2205720 12/1988 United Kingdom .

*Primary Examiner*—Philip H. Leung
*Attorney, Agent, or Firm*—Seidel, Gonda, Lavorgna & Monaco

[57] ABSTRACT

Induction heating apparatus, e.g. for melting, has induction coil sections, each associated with a respective zone of the melt or other work load, the power applied to each section from a supply being controlled individually through a saturable reactor respective to each section and each operable to shunt a proportion of power applicable in that section in response to regulation of excitation of the respective reactor related to a demand signal derived from the operation of the respective zone, so that the temperature in each zone is regulated independently of the regulation of the other zone(s).

9 Claims, 4 Drawing Sheets

MULTIPLE ZONE INDUCTION HEATING

FIELD OF THE INVENTION

This invention relates an induction heating apparatus, for example for the induction melting of metals and/or their alloys.

BACKGROUND OF THE INVENTION

In some applications it is desirable that the operating temperature of the melt or other work load is under close control and is maintained accurately at predetermined levels in respective zones of the load operated on by respective sections of the induction heating means.

The object of the invention is to provide reliable and effective zone control of operating temperature operating automatically within close limits and with high efficiency.

SUMMARY OF THE INVENTION

According to the invention there is provided an induction heating apparatus including induction coil means operatively associated with a melt or other work load to be heated, said coil means being divided into a plurality of defined sections each associated with a respective zone of the work load in use; power supply means for providing power input to the induction coil means; and control means for regulating the power applied to each said section of the coil means for regulation of the operating temperature in the respective associated zone characterized in that the control means includes a saturable reactor responsive to and connected across each section of the coil means and each selectively operable to shunt at least a substantial proportion of the maximum power which can be applied in that section in response to regulation of the excitation of the reactor, and means for regulating said excitation respective to each reactor operation in that zone.

Preferably the power supply means provides power to the whole induction coil means across all its sections in common. Typically said power supply is a medium frequency D.C. power supply, typically a series resonant voltage fed inverter providing power variation and control by regulation of the frequency of the power applied to an associated load circuit.

The individual power demands derived from operation in each said zone are preferably summed by the control means to regulate the power output of said inverter and the arrangement can desirably be such that there is minimum cross coupling between the respective sections of the coil means so as to ensure operation at optimum efficiency.

Provision may be included for manual and/or automatic control of the level of power applied in each zone in use for close regulation of the operating temperature therein.

BRIEF DESCRIPTION OF THE DRAWINGS

An example of the invention will now be more particularly described with reference to the accompanying drawings in which.

DETAILED DESCRIPTION OF THE PREFERRED EMBODIMENTS

Figure 1:
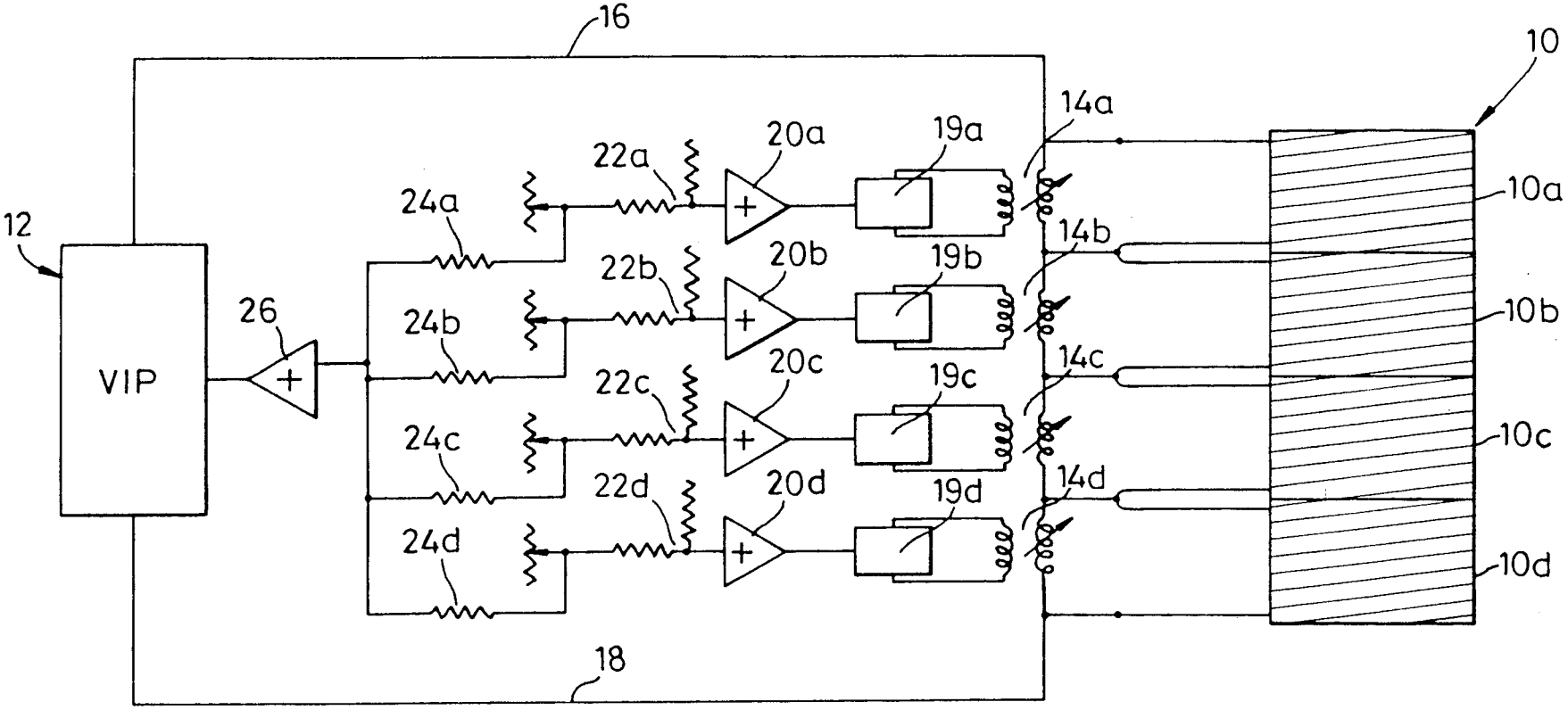
FIG. 1 is a circuit diagram of an induction heating apparatus embodying the invention.

The apparatus includes an induction coil 10 represented diagrammatically to be operatively associated with a work load (not shown) e.g. melt of alloy or other metal contained in a suitable vessel in known manner.

In this example coil 10 is divided into four equal sections 10*a,b,c*, and *d* which are defined by tappings further referred to hereafter. It is to be understood that any number of sections from two upwards could be provided, also that for some applications said sections could be unequal in size and/or have other differing characteristics. Each section is associated with a respective zone of the work load.

Power supply means of this example of the apparatus is a series resonant voltage fed inverter 12 of known construction operatively fed from a mains or other supply (not shown) which feeds the whole of coil 10, the power applied to the latter being varied and controlled by varying the frequency of D.C. power output from the inverter.

The power operatively applied to each zone of the work load is controlled individually through control means of the apparatus. Said means includes a set of four saturable reactors 14*a,b,c* and *d* each having a load coil connected across the tappings of coil 10 so that each is disposed in parallel with a respective coil section 10*a,b,c* and *d*. Said load coils are also interconnected in series across common feed leads 16, 18, said leads connecting back to the output side of the inverter 12. D.C. control coils of the reactors 14 are each connected across a respective controllable D.C. power supply 19*a,b,c* and *d*.

Reactors 14 are arranged so that the applied D.C. excitation will vary their reactance in a range from a high value with no D.C. applied to a low value with maximum D.C. application.

Generally it can be assumed that with a maximum current IM flowing in all sections of coil 10 with all the reactors 14 unsaturated and at high reactance that each reactor must be capable of shunting at least $\frac{2}{3}$ IM leaving $\frac{1}{3}$ IM in each respective section of coil 10. Thus the power applied to each respective zone of the work load is controlled by regulating the D.C. in the respective reactors 14 as referred to above from full power down to approximately one ninth full power in each zone.

The power requirement for each zone is monitored by a respective zone power demand signal which is operatively compared with the power feedback of the respective coil sections through a set of comparator amplifiers 20*a,b,c* and *d* each connected to a respective power supply 19. Feedback from comparators 20 is applied through respective zone power feedback devices 22*a,b,c* and *d* connected between comparators 20 and respective zone power summing resistors 24*a,b,c* and *d* arranged in parallel with each other. The outputs from the latter are connected in common to a zone power summing amplifier 26 which in turn regulates the operation of the inverter 12.

The D.C. excitation of each saturable reactor 14 is thus controlled by an error signal generated by the associated comparator for appropriate control of the D.C. power supply output and each zone power demand signal is summed to provide the total demand determining the output from the inverter 12. This arrangement ensures that there is minimum cross coupling between the sections of the coil 10 while ensuring operation at optimum efficiency.

Figure 2:
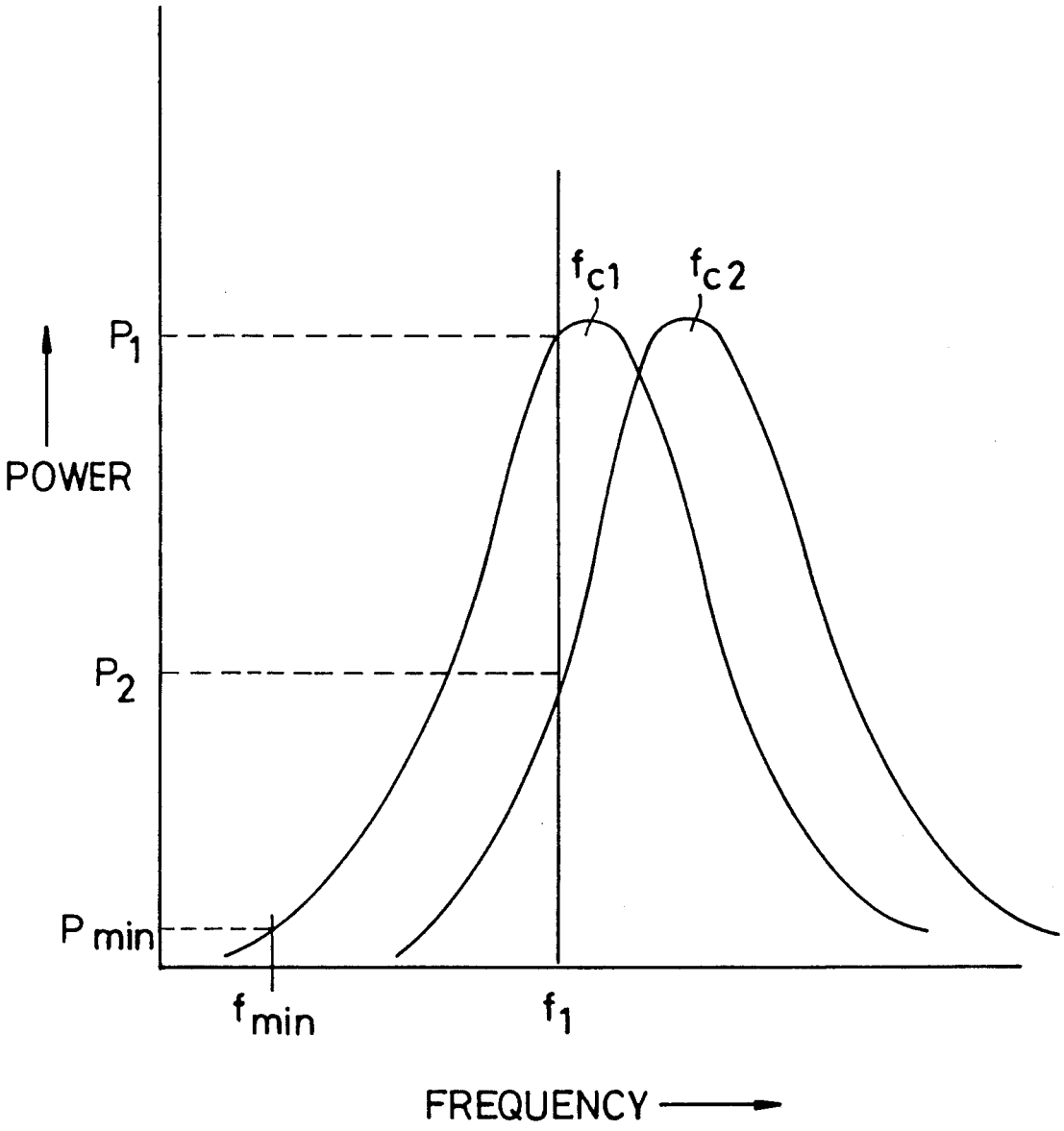
FIG. 2 is a graph of power and frequency characteristics of said circuit.

The power and frequency characteristics of a typical inductive load circuit operating as in the present example is shown diagrammatically in FIG. 2. A typical circuit will be fed by a series capacitor. Maximum power $P_1$ is limited to frequency $f_1'$ a value below $f_{C1}$ (the resonant frequency) and the power can be controlled down to $P_{min}$ by reducing the excitation frequency to $f_{min}$.

In the particular case of the multi-zone control provided by the described apparatus the operation is as follows:

Consider little $f_1$ and $P_1$ as the steady state operating parameters of the combined zones at a particular time. If one zone is then required to operate at reduced power, e.g. to control the temperature in that zone independently of the other zones, the excitation of the saturable reactor 14 associated with the section of coil 10 respective to that zone will be increased to bypass the current of that section. The net inductance of the load is decreased and the load characteristics will change as indicated in FIG. 2 to $f_{C2}$ resonant frequency. The sum of power in all zones (i.e. sections of coil 10) will then decrease from $P_1$ to $P_2$ with minimal change in frequency. Thus if the required change in power in the zone under consideration is $P_1$–$P_2$ then the net power supplied by the inverter 12 to the whole of coil 10 (i.e. all the sections connected in series) must be decreased by the same amount. The remaining zones (i.e. coil sections) will therefore continue to operate without change of power and without any substantial change in frequency. With this arrangement the individual modulation of power applied to any coil section does not produce cross coupled modulation in the other sections.

The operating temperature in each individual zone will be monitored with feedback to the control means associated with the coil section respective to that zone so that the temperature therein can be maintained at a desired level within close limits and independently of the control applied in the other zone or zones.

Figure 3:
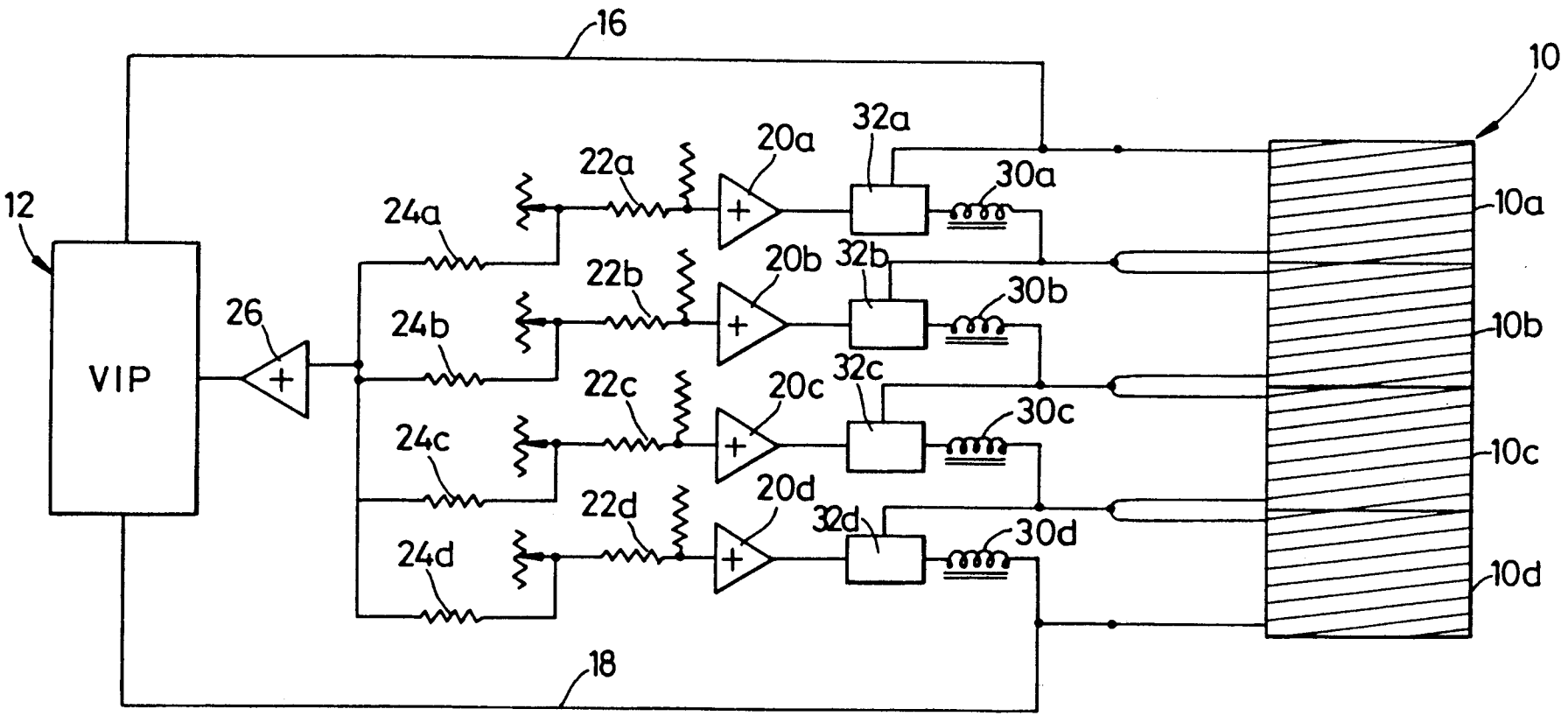
FIG. 3 is a circuit diagram of said apparatus having an alternative form of control means.
Figure 4:
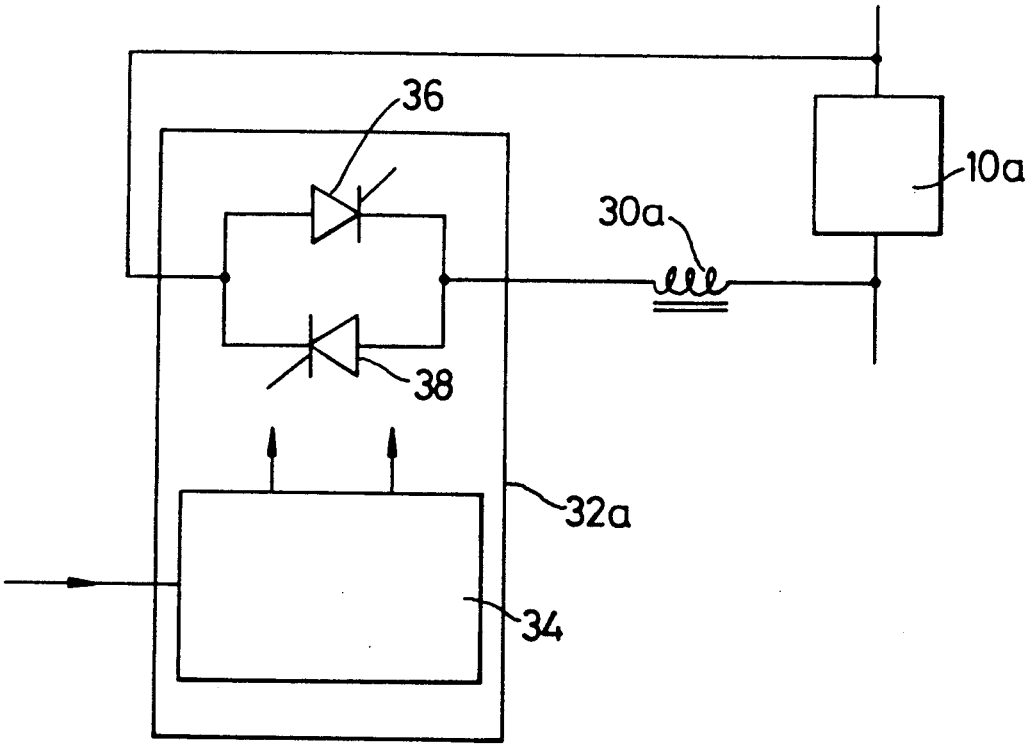
FIG. 4 is a more detailed diagram of a thyristor controlled reactor of the latter control means.

FIGS. 3 and 4 show a modification of the apparatus described above, though the operating principles and characteristics are generally the same and will not be reacted in detail. Much of the power supply means, together with the sectional induction coil 10, are as described above and the same reference numerals are used in FIG. 3 for components common with FIG. 1.

Instead of the saturable reactors 14 and associated control power supplies 19 of the apparatus described with reference to FIG. 1, the control means in this modification employs a reactor 30*a, b, c* and *d* with associated thyristor control 32*a, b, c* and *d* respectively connected across each coil section 10*a, b, c* and *d*. One said reactor and control, associated with section 10*a*, is shown in greater detail in FIG. 4.

Each thyristor control 32 includes thyristor control circuits 34 (FIG. 4) responding to a control signal driven from the associated comparators amplifier 20 to regulate the firing mode of the thyristors 36, 38 which in turn control the reactance of the respective reactor 30. The reactor current is shunted in parallel with the respective coil section being controlled, with control in a range of from full power to approximately one-ninth thereof in each zone as referred to above.

The value of the fixed reactor inductance is assessed to shunt $\frac{2}{3}$ IM when conducting continuously for the full cycle on inverter frequency. The control circuits 34 may be arranged and operated to provide either phased or burst firing control of the associated reactor current, said current being increased, as referred to above, if the related coil section is to operate at reduced power.

I claim:

1. Induction heating apparatus comprising:

induction coil means operatively associated with a melt or other work load to be heated, said coil means being divided into a plurality of defined sections each associated with a respective zone of the work load in use;

power supply means for providing power input to the induction coil means; and a plurality of control means each for individually regulating the power applied to each said section of the coil means, respectively, for regulation of the operating temperature in the respective associated zone characterized in that each control means includes fixed reactor responsive to at least one electronic switch means and connected between the coil means and the at least one electronic switch means, and each selectively operable to shunt at least a substantial proportion of the maximum power which can be applied in that section in response to regulation of the excitation of the reactor by the electronic switch means, said electronic switch means regulating said excitation respective to each reactor as a function of a demand signal derived from the operation in that zone.

2. Apparatus as in claim 1 wherein the power supply means provides power to the whole induction coil means across all its sections in common.

3. Apparatus as in claim 2 wherein the power supply means is a medium frequency D.C. power supply.

4. Apparatus as in claim 3 wherein the power supply comprises a series resonant voltage fed inverter.

5. Apparatus as in claim 4 includign means for regulating the frequency of power operatively applied to a load circuit associated with the power supply to provide power variation and control of said inverter.

6. Apparatus as in claim 4 wherein the control means includes means for summing individual power demands derived from the operation of each said work load zone and applying a value so derived to regulate the power output from said inverter.

7. Apparatus as in claim 1 so disposed that there is minimum cross coupling between the respective sections of the coil means.

8. Apparatus as in claim 1 wherein the cotnrol means includes means for automatic control of the level of power applied in each said zone in use for regulation of the operating temperature therein.

9. Apparatus as in claim 8 wherein the control means further includes means for manual control of said level of power applied in each said zone.

* * * * *

UNITED STATES PATENT AND TRADEMARK OFFICE

CERTIFICATE OF CORRECTION

PATENT NO. : 5,059,762

DATED : October 22, 1991

INVENTOR(S) : John H. Simcock

It is certified that error appears in the above-identified patent and that said Letters Patent is hereby corrected as shown below:

Column 1, line 43, delete "D.C."

Column 2, line 23, delete "D.C."

Column 3, line 62, change "reactance" to --current--

Col. 4, claim 3, line 41, delete "D.C.".

Signed and Sealed this

Twentieth Day of April, 1993

*Attest:*

MICHAEL K. KIRK

*Attesting Officer*

*Acting Commissioner of Patents and Trademarks*